US010893700B2

(12) United States Patent
Mishra et al.

(10) Patent No.: US 10,893,700 B2
(45) **Date of Patent: *Jan. 19, 2021**

(54) SMOKING ARTICLE FILTER WITH FLAVORANT DELIVERY SYSTEM

(71) Applicant: Altria Client Services LLC, Richmond, VA (US)

(72) Inventors: Munmaya K. Mishra, Manakin Sabot, VA (US); Alex Jordan, Midlothian, VA (US); Kathryn M. Draper, Moseley, VA (US); Dwight D. Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/683,700

(22) Filed: Nov. 14, 2019

(65) Prior Publication Data

US 2020/0077697 A1 Mar. 12, 2020

Related U.S. Application Data

(63) Continuation of application No. 15/631,851, filed on Jun. 23, 2017, now Pat. No. 10,499,686.

(51) Int. Cl.

| | |
|---|---|
| ***A24D 3/06*** | (2006.01) |
| ***A24D 3/04*** | (2006.01) |
| ***A24B 15/28*** | (2006.01) |
| *A24D 1/02* | (2006.01) |

(52) U.S. Cl.

CPC ..... *A24D 3/061* (2013.01); *A24B 15/283* (2013.01); *A24D 3/048* (2013.01); *A24D 1/02* (2013.01)

(58) Field of Classification Search

CPC ..... A24D 3/061

See application file for complete search history.

(56) References Cited

U.S. PATENT DOCUMENTS

| | | | | |
|---|---|---|---|---|
| 3,390,686 A | | 7/1968 | Irby, Jr. et al. | |
| 4,687,008 A | | 8/1987 | Houck, Jr. et al. | |
| 4,861,324 A | * | 8/1989 | Hirose | A24D 3/0225 493/48 |
| 4,889,144 A | | 12/1989 | Tateno et al. | |
| 4,966,169 A | | 10/1990 | Waddell et al. | |
| 5,186,185 A | | 2/1993 | Mashiko et al. | |

(Continued)

FOREIGN PATENT DOCUMENTS

| | | |
|---|---|---|
| CH | 468160 A | 2/1969 |
| CH | 648733 A5 | 4/1985 |

(Continued)

*Primary Examiner* — Eric Yaary

(74) *Attorney, Agent, or Firm* — Buchanan Ingersoll & Rooney PC

(57) ABSTRACT

A breakable capsule such as a seamless breakable capsule useful in a smoking article or a smokeless tobacco product includes an outer shell formed of a cross-linked agar matrix including at least one filler, and an inner core surrounded by the outer shell which comprises a liquid or gel based composition of a flavorant and/or non-flavorant. The cross-linked agar matrix is reinforced with carboxymethyl cellulose that is dispersed throughout the agar matrix so as to fill empty spaces in the agar matrix and inhibit the composition from passing through the empty spaces of the agar matrix.

19 Claims, 1 Drawing Sheet

(56) References Cited

U.S. PATENT DOCUMENTS

| | | | |
|---|---|---|---|
| 5,499,636 | A | 3/1996 | Baggett, Jr. et al. |
| 5,666,976 | A | 9/1997 | Adams et al. |
| 5,692,525 | A | 12/1997 | Counts et al. |
| 5,692,526 | A | 12/1997 | Adams et al. |
| 5,915,387 | A | 6/1999 | Baggett, Jr. et al. |
| 5,988,176 | A | 11/1999 | Baggett, Jr. et al. |
| 6,026,820 | A | 2/2000 | Baggett, Jr. et al. |
| 7,878,962 | B2 | 2/2011 | Karles et al. |
| 7,972,254 | B2 | 7/2011 | Stokes et al. |
| 8,079,369 | B2 | 12/2011 | Andresen et al. |
| 8,308,623 | B2 | 11/2012 | Nelson et al. |
| 9,010,337 | B2 | 4/2015 | Kobal |
| 9,247,770 | B2 | 2/2016 | Barnes et al. |
| 2004/0129280 | A1 | 7/2004 | Woodson et al. |
| 2005/0000531 | A1 | 1/2005 | Shi |
| 2005/0172976 | A1 | 8/2005 | Newman et al. |
| 2006/0174901 | A1 | 8/2006 | Karles et al. |
| 2008/0017206 | A1 | 1/2008 | Becker et al. |
| 2008/0142028 | A1 | 6/2008 | Fagg |
| 2009/0050163 | A1 | 2/2009 | Hartmann et al. |
| 2009/0288667 | A1 | 11/2009 | Andresen et al. |
| 2011/0232659 | A1 | 9/2011 | Ercelebi et al. |
| 2011/0271968 | A1 | 11/2011 | Carpenter et al. |
| 2012/0024305 | A1 | 2/2012 | Liu et al. |
| 2012/0255569 | A1 | 10/2012 | Beard et al. |
| 2012/0298123 | A1 | 11/2012 | Woodcock et al. |
| 2014/0137878 | A1 | 5/2014 | Karles et al. |
| 2014/0290678 | A1* | 10/2014 | Besso ..... A24D 3/04 131/337 |
| 2016/0021927 | A1 | 1/2016 | Kondo |
| 2016/0302478 | A1 | 10/2016 | Lavanant |

FOREIGN PATENT DOCUMENTS

| | | | |
|---|---|---|---|
| CN | 102106606 | A | 6/2011 |
| GB | 2 490 730 | A | 11/2012 |
| WO | 2003009711 | A1 | 2/2003 |
| WO | 2012156699 | A1 | 11/2012 |

* cited by examiner

SMOKING ARTICLE FILTER WITH FLAVORANT DELIVERY SYSTEM

CROSS REFERENCE TO RELATED APPLICATION

The present application is a continuation patent application of U.S. application Ser. No. 15/631,851, filed Jun. 23, 2017, the entire contents of which is hereby incorporated by reference.

TECHNICAL FIELD

This disclosure relates to smoking article filters with flavorant delivery during smoking of combustible or non-combustible tobacco products.

BACKGROUND

The taste of mainstream smoke from smoking articles containing tobacco can be modified by incorporating various flavor-enhancing agents ("flavorants") as additives into the smoking articles. For instance, tobacco smoke passing through a carbon sorbent material can lose favorable taste attributes. Thus, adding various flavorants back into tobacco smoke to replace lost flavorants is desirable. However, the enhancement in the taste of smoking articles by known methods is not long-lasting and may result in products having inconsistent flavor. Volatile flavors incorporated into smoking products are not stably retained. Flavorants may inadvertently migrate into sorbents of cigarette filters capable of removing gas-phase constituents. Further flavorants superficially applied to either the tobacco-containing portion or the packaging portion of cigarette products may be irreversibly lost.

SUMMARY

Disclosed herein is a smoking article filter having a multi-stage flavorant delivery system, the smoking article filter comprising plug wrap surrounding filter material containing the multi-stage flavorant delivery system, the multi-stage flavorant delivery system comprising at least one pressure sensitive capsule containing a first flavorant and at least one heat sensitive capsule containing a second flavorant, the at least one heat sensitive capsule located upstream of the at least one pressure sensitive capsule, the at least one heat sensitive capsule releasing the second flavorant by mainstream smoke passing through the smoking article filter and the at least one pressure sensitive capsule releasing the first flavorant by manual rupture of an outer wall of the pressure sensitive capsule.

According to an embodiment, a method of making a smoking article filter comprises wrapping first and second filter segments in plug wrap, wherein at least one pressure sensitive capsule is incorporated in the first filter segment and at least one heat sensitive capsule is incorporated in the second filter segment. In this method, the wrapping preferably comprises feeding the plug wrap along a feed path and wrapping the plug wrap around filter tow material traveling along the feed path, wherein the first filter segment comprises a first section of the filter tow traveling along the feed path and the second filter segment comprises a second section of the filter tow traveling along the feed path. In an example, at least two of the pressure sensitive capsules can be embedded in the first section of filter tow and at least two of the heat sensitive capsules can be embedded in the second section of filter tow.

The at least one pressure sensitive capsule can comprise an outer shell formed of a cross-linked agar matrix including at least one filler and an inner core surrounded by the outer shell which comprises a liquid or gel based composition of the first flavorant, wherein the cross-linked agar matrix is reinforced with carboxymethyl cellulose dispersed throughout the agar matrix so as to fill empty spaces in the agar matrix and inhibit the composition from passing through the empty spaces of the agar matrix and the at least one filler comprises locust bean gum, konjac, and/or xanthan gum. The at least one filler can further include pullulan, hydroxypropyl methyl cellulose (HPMC), hydroxypropyl cellulose (HPC), soluble cellulose gum, methyl cellulose, dextrin, maltodextrin, and combinations thereof. The outer shell may be formed of a gelatin. In an embodiment, the pressure sensitive capsule is effectively water insoluble.

The at least one heat sensitive capsule can comprise a water soluble shell and a core containing the second flavorant and the outer shell can include one or more of polysaccharide, agar and cellulose. The at least one pressure sensitive capsule is preferably a seamless capsule having a crush strength of about 3 to about 10 Newtons and the at least one heat sensitive capsule is preferably a plurality of microcapsules having diameters less than about 2 mm.

The first and second flavorants can be selected from the group consisting of licorice, wintergreen, cherry and berry type flavorants, dramboui, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ilangilang, sage, fennel, piment, ginger, anise, coriander, coffee, salts, sweeteners, carbohydrates, mint oils from a species of the genus mentha, eugenol, cocoa, citrus, fruit flavors, and combinations thereof. In an embodiment, the first flavorant is different than the second flavorant. In another embodiment, the first and second flavorants are the same flavorant.

In an embodiment, the at least one heat sensitive capsule comprises at least two heat sensitive capsules embedded in filter material and the at least one pressure sensitive capsule comprises at least two pressure sensitive capsules embedded in filter material.

In another embodiment, a smoking article comprises the smoking article filter described above. As an example, the at least one pressure sensitive capsule can comprise at least two pressure sensitive capsules embedded in filter material and the at least one heat sensitive capsule can comprise at least two heat sensitive capsules embedded in filter material. The smoking article filter can be attached to a tobacco rod of a cigarette wherein an outer shell of the at least one heat sensitive capsule can rupture and release the second flavorant during combustion of the tobacco rod and passage of mainstream smoke through the smoking article filter.

Also disclosed herein is a method of making the smoking article filter described above wherein at least one pressure sensitive capsule is incorporated in a first filter segment and at least one heat sensitive capsule is incorporated in second filter segment, and the first and second filter segments are wrapped in plug wrap. In an embodiment, the plug wrap is wrapped around filter tow material traveling along a feed path, wherein the first filter segment comprises a first section of the filter tow traveling along the feed path and the second filter segment comprises a second section of the filter tow traveling along the feed path. In an embodiment, at least two of the pressure sensitive capsules are embedded in the first section of filter tow and at least two of the heat sensitive capsules are embedded in the second section of filter tow.

According to another embodiment, a method of making a smoking article comprises attaching the smoking article filter described above to a tobacco rod wherein the at least on heat sensitive capsule is located upstream of the at least one pressure sensitive capsule. As an example, at least two of the pressure sensitive capsules can be embedded in filter tow material and at least two of the heat sensitive capsules can be embedded in the filter tow material.

DETAILED DESCRIPTION

As disclosed herein, a smoking article filter having a multi-stage flavorant delivery system comprises plug wrap surrounding filter material containing the multi-stage flavorant delivery system. The multi-stage flavorant delivery system comprises at least one pressure sensitive capsule containing a first flavorant and at least one heat sensitive capsule containing a second flavorant. The at least one heat sensitive capsule is located upstream of the at least one pressure sensitive capsule. During smoking of a smoking article incorporating the smoking article filter, the at least one heat sensitive capsule releases the second flavorant when mainstream smoke passes through the smoking article filter. The at least one pressure sensitive capsule can release the first flavorant on demand by manual rupture of an outer wall of the pressure sensitive capsule. Thus, an adult smoker has the choice of rupturing or not rupturing the pressure sensitive capsule during smoking. For example, the pressure sensitive capsule can be ruptured prior to smoking, during smoking, or after smoking is concluded. If the smoking article filter includes two or more pressure sensitive capsules, the adult smoker can rupture the capsules at different times to release the same or different flavors.

Figure 1A:
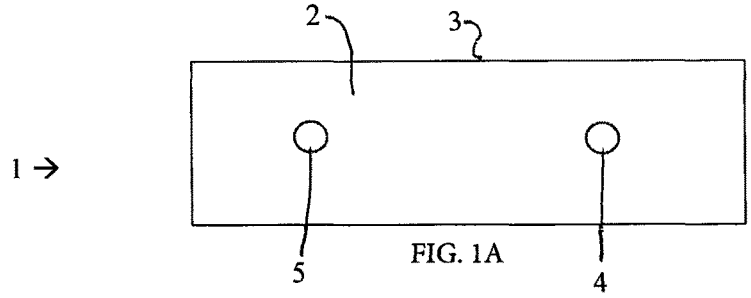
FIGS. 1A and 1B illustrate smoking article filters according to embodiments disclosed herein.
Figure 1B:
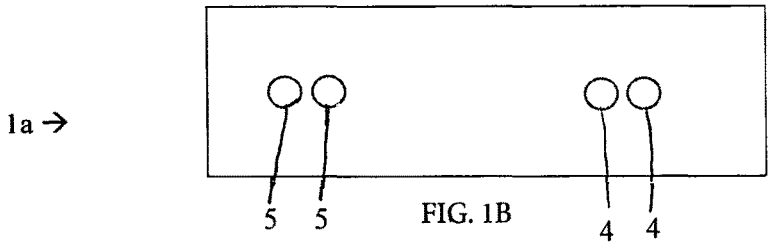

FIG. 1A shows an embodiment of a smoking article filter 1 having filter material 2 wrapped in plug wrap 3 with a heat sensitive capsule 4 at an upstream location and a pressure sensitive capsule 5 at a downstream location. In another embodiment, a smoking article filter 1*a* includes at least two heat sensitive capsules 4 at an upstream location and at least two pressure sensitive capsules 5 at a downstream location, as shown in FIG. 1B.

Figure 2:
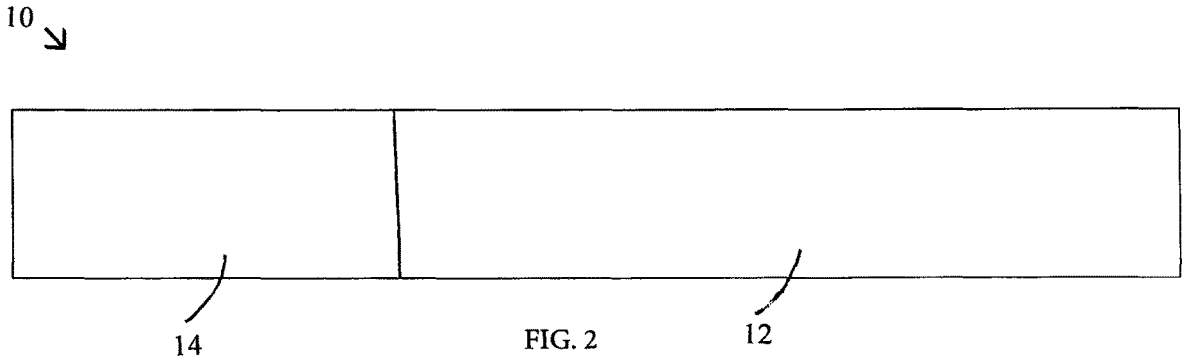
FIG. 2 illustrates a smoking article including the smoking article filter according to an embodiment disclosed herein.

As shown in FIG. 2, a smoking article 10, for example, a cigarette, contains two sections, a tobacco-containing portion sometimes referred to as the tobacco or cigarette rod 12, and a filter portion or filter 14. Tipping paper typically surrounds the filter 14, which forms the mouth end of the cigarette. The tipping paper overlaps with the tobacco rod in order to hold the filter and tobacco rod together. The tobacco rod 12, or tobacco containing element of the cigarette, includes the paper wrapper in which the tobacco is wrapped and the adhesive holding the seams of the paper wrapper together. The tobacco rod 12 has a first end, which is integrally attached to the filter, and a second end, which is lit or heated for smoking the tobacco. When the tobacco rod 12 is lit or heated for smoking, the smoke travels from the lit end downstream to the filter end of the tobacco rod and further downstream through the filter.

The filter 14 can be used with cigarettes and electronic cigarettes. Electronic cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636, the disclosures of which are incorporated by reference herein in their entireties.

In accordance with an exemplary embodiment, the capsules 4,5 can have a core (matrix) and may include one or more layers surrounding the core. The layers can include a coating/binder and may include additional flavor, tobacco/tobacco flavor, and any other additive or combination thereof. For example, the matrix and/or core may include a carbohydrate, a water soluble or insoluble polymer, a flavorant, or a combination thereof. In accordance with an exemplary embodiment, the heat sensitive capsule 4 has a shell which releases flavorant during passage of mainstream smoke through the smoking article filter. For example, the heat sensitive capsule can be a spherical capsule with an outer diameter of 2 mm or less. In contrast, the pressure sensitive capsule has a shell which is not ruptured by the mainstream smoke and instead maintains its integrity until manually ruptured by an adult smoker. For example, the pressure sensitive capsule can be spherical with an outer diameter of 2 to 5 mm.

Disclosed herein are embodiments of capsules such as seamless breakable capsules and methods of forming seamless breakable capsules. In an embodiment, a capsule such as a seamless capsule can include an outer shell and an inner core that contains a composition (also referred to herein as "core content"), such as a liquid or gel composition, that may be released from the capsule when the outer shell thereof is ruptured manually or by thermal degradation. Preferably the capsules are spherical or substantially spherical.

Before or during combustion of a smoking article including the at least one pressure sensitive capsule, an adult smoker can break (i.e., rupture) the outer shell thereof so as to release the composition of the inner core to a region of the smoking article through which mainstream smoke travels during a puff on a lit smoking article. In this manner, the composition released from the ruptured capsule may be used to alter the flavor, physical properties, and/or chemical properties of the mainstream smoke that travels through the region to which the composition is released before being inhaled by an adult smoker. In addition, to provide flavor impact to the mainstream smoke during initial puffs, the heat sensitive capsule preferably releases flavorant to the mainstream smoke after one or two puffs.

The pressure sensitive capsule can include an outer shell and an inner core that includes a composition of one or more flavor-enhancing agents ("flavorant") and/or one or more agents that exhibit desired chemical or physical properties ("non-flavorant"). The composition of the inner core can be a liquid or gel, and can contain optional solid particles or granules, such as crystalized menthol. The outer shell can be formed of a cross-linked agar matrix that includes at least one filler. Preferably, the at least one filler is locust bean gum. The cross-linked agar matrix is reinforced with carboxymethyl cellulose (CMC) that is dispersed throughout the agar matrix. The carboxymethyl cellulose fills empty spaces in the agar matrix, which provides a barrier that inhibits the composition of the inner core from passing through the empty spaces of the agar matrix, and thereby a pressure sensitive capsule which is not prone to leaking may be formed.

The carboxymethyl cellulose can form a continuous or discontinuous phase of material and is preferably included in the outer shell so as to fill a sufficient amount of empty spaces in the agar matrix such that the inner composition is prevented from passing through the reinforced agar matrix. Preferably, the carboxymethyl cellulose fills at least about 90% of the empty spaces of the cross-linked agar matrix. More preferably, the carboxymethyl cellulose fills at least about 99% of the empty spaces of the cross-linked agar matrix. Most preferably, the carboxymethyl cellulose forms a continuous phase of material that completely fills the empty spaces of the cross-linked agar matrix. Accordingly, the composition of the inner core can be prevented from leaking from the outer shell unless sufficient pressure is applied to the outer shell. Thus, an adult smoker may apply pressure to the pressure sensitive capsule before or during use of a tobacco product including the at least one pressure sensitive capsule such that the outer shell thereof ruptures and releases the composition of the inner core. Because the carboxymethyl cellulose is water soluble, the outer shell can also include an optional outer coating on an outer surface thereof, such as a coating of ethyl cellulose, which seals the capsule from outside humidity.

The composition of the inner core including the one or more flavorants and/or one or more non-flavorants is selected to provide desired flavor and/or physical/chemical properties to mainstream smoke inhaled by an adult smoker during a puff on a smoking article including the at least one pressure sensitive capsule. In addition, the heat sensitive capsule can provide desired flavor and/or physical/chemical properties to the mainstream smoke during initial puffs on the smoking article.

Examples of flavorants that can be used to form, or included in, the composition of the inner core of the heat sensitive capsule and the pressure sensitive capsule can include, without limitation, licorice, wintergreen, cherry and berry type flavorants, Dramboui, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ilangilang, sage, fennel, piment, ginger, anise, coriander, coffee, salts, sweeteners, carbohydrates, mint oils from a species of the genus mentha, eugenol, cocoa, citrus or other fruit flavors and combinations thereof. Examples of non-flavorants that can be included in the inner core of the pressure sensitive and heat sensitive capsules can include, without limitation, sensates such as cooling agents, diluents, aerosol formers, and/or other equivalents. Preferably, a diluent such as medium-chain triglyceride (MCT) oil is used in the composition. MCT oil is stable and has a neutral flavor.

The outer shell of the pressure sensitive capsule can be formed from a shell forming solution during a co-extrusion process in which the outer shell is formed around the composition that makes up the inner core. The shell forming solution that forms the outer shell can include agar as a gelling agent, in combination with carboxymethyl cellulose (CMC), one or more fillers, purified water, and/or other ingredients. For example, the one or more fillers can include locust bean gum, konjac, and/or xanthan gum. Fillers can also include a low viscosity polymer such as polymaltotriose (pullulan). Alternatively, or in addition to pullulan, the filler can include cellulose derivatives such as hydroxypropyl methyl cellulose (HPMC), hydroxypropyl cellulose (HPC), soluble cellulose gum, methyl cellulose, and/or a starch derivative such as dextrin or maltodextrin. The shell forming solution can also include glycerin, sorbitol, sodium chloride, guar gum, gum arabic, and/or inulin. The outer shell may be formed of a gelatin. In an embodiment, the pressure sensitive capsule is effectively water insoluble.

The shell forming solution includes carboxymethyl cellulose (CMC). Carboxymethyl cellulose acts as a binder in the shell forming solution and also acts to increase the viscosity of the shell forming solution. However, an increase in the concentration of carboxymethyl cellulose in the shell forming solution disproportionately increases the viscosity of the solution. Without wishing to be bound by theory, the carboxymethyl cellulose in the shell forming solution forms a continuous or discontinuous phase through hydrogen bonding of its free hydroxyl groups. When dried, the carboxymethyl cellulose can reinforce the cross-linked agar matrix of the outer shell by filling in empty spaces or pores thereof. In an embodiment, the carboxymethyl cellulose can be cross-linked with the agar-matrix. The carboxymethyl cellulose is included in the shell forming solution used to form an outer shell of a pressure sensitive capsule in an amount effective to inhibit the composition of the inner core from passing through the agar matrix such that the composition does not leak from the capsule. In this manner, the porosity of the outer shell can be reduced such that the outer shell does not require an outer coating to be applied thereto to seal the outer shell and prevent the composition from leaking therefrom, and the cost of manufacturing the capsules can be reduced. In an embodiment, the shell forming solution can also include one or more carbohydrates such as an alginate or pectin, which can be cross-linked with the agar matrix.

The pressure sensitive capsules according to embodiments as disclosed herein have a crush strength such that the outer shell will not rupture unless a sufficient force is applied to the outer shell. Preferably, the pressure sensitive capsules have a crush strength of about 3 to about 10 Newtons. The pressure sensitive capsules are preferably seamless and spherical or substantially spherical in shape, and preferably each pressure sensitive capsule formed according to an embodiment disclosed herein has an approximately constant diameter. In an embodiment, the seamless pressure sensitive capsules have an outer diameter of about 2 to 4.5 mm, such as a diameter of about 2.5 to 4.5 mm, and more preferably an outer diameter of 3.5 to 4.5 mm.

The smoking article filter preferably includes at least one seamless pressure sensitive capsule therein. In an embodiment, the at least one seamless pressure sensitive capsule can be embedded in the filter material or located in a void space of the filter element. Alternatively, the at least one seamless pressure sensitive capsule can be disposed in a hollow cavity between two conventional cigarette filter segments such as plugs of cellulose acetate.

Before and/or during smoking, an adult smoker may use finger pressure to break the at least one seamless pressure sensitive capsule so as to release the composition of the inner core. The composition of the inner core can include flavorants and/or non-flavorants wherein during smoking the flavorants and/or non-flavorants can be released from the seamless pressure sensitive capsule and combine with mainstream smoke during a puff on the smoking article. In an embodiment, the flavorants and/or non-flavorants can modify the composition of the mainstream smoke to enact a desired effect.

In an embodiment, the smoking article filter includes heat sensitive capsules containing flavorant such as menthol in the core surrounded by a thermally degradable outer shell of the capsule. As the cigarette is smoked, the shell of the capsule can become degraded by the mainstream smoke flowing past the capsule, thereby releasing the menthol into the mainstream smoke. The heat sensitive capsules can include later, as the cigarette continues to be smoked, the menthol in the first liquid flavorant composition in the core is released to the mainstream smoke as the inner shell degrades. The result is that the adult smoker enjoys increased menthol flavor at different points in the smoking experience.

In another example, the smoking article filter includes at least one slow release heat sensitive capsule including a flavorant such as menthol and at least one quick release heat sensitive capsule including a different flavorant such as tobacco extract. As the cigarette is smoked, the outer shell of the quick release heat sensitive capsule degrades in the moist, hot mainstream smoke, releasing tobacco flavor, thereby enhancing the tobacco flavor of the mainstream smoke. As smoking continues, the outer shell of the slow release heat sensitive capsule degrades, releasing menthol flavor into later puffs of the mainstream smoke.

In either of these examples, multiple heat sensitive capsules can be disposed in the smoking article cigarette filter, and their disposition can have an effect on the delivery of flavorant to the adult smoker. For instance, disposing multiple capsules having the same or similar thicknesses of shells at the same or similar location in the smoking article filter can result in an increase of a particular flavor over a relatively short time. Because each of the capsules is subjected to similar degradation conditions, the shells will degrade at similar rates, releasing their flavorants at similar times.

In another embodiment, it is possible to vary the release rates of flavorant from different capsules by varying the thickness and other mechanical properties of the shells. This allows for the capsules to be engineered for different locations in the article, thereby controlling flavorant release with time. For example, capsules having relatively thick shells can be disposed near the mouth end of a cigarette filter, while capsules having relatively thin shells can be disposed near the tobacco rod end of the cigarette filter. The thin shelled capsules are heat sensitive capsules which thermally degrade and release the flavorant contained therein during the first puffs on the cigarette whereas the thick shelled capsules are pressure sensitive capsules which can retain their flavorant for a longer time when subjected to mainstream smoke, so that the adult smoker can manually rupture the pressure sensitive capsules to experience flavorant release later in the smoking experience. Cigarettes including encapsulated flavoring are described in U.S. Patent Application Publication Nos. 2005/0172976, 2008/0017206 and 2012/0024305, each of which is herein incorporated by reference in its entirety.

If desired, the smoking article filter can include any agent exhibiting chemical or physical properties of interest ("non-flavorants") that may be optionally included within the capsules to achieve a desired product. Examples of non-flavorants include cooling agents, diluents, aerosol formers, and many other equivalents.

As used herein, "heated" or "heating" is intended to include elevating the temperature of an encapsulated additive to the point at which thermal degradation occurs such that the heat sensitive capsule releases the flavorant and/or additive through at least partial degradation of at least a portion of the capsule shell. The term "mainstream smoke" includes the mixture of gases and/or aerosols passing down a smoking article, such as a tobacco rod, and issuing from an end, such as through the filter end, i.e., the amount of smoke issuing or drawn from the mouth end of a cigarette during smoking of the cigarette. The mainstream smoke contains air that is drawn in through the heated region of the cigarette and through the paper wrapper. "Smoking" of a cigarette (or smoking article) means the heating, combusting or otherwise causing a release of certain chemicals from tobacco. Generally, smoking of a cigarette involves lighting one end of the cigarette and drawing the smoke downstream through the mouth end of the cigarette, while the tobacco contained therein undergoes a combustion reaction. However, the cigarette may also be smoked by other means, as mentioned above.

In this specification, the word "about" is often used in connection with numerical values to indicate that mathematical precision of such values is not intended. Accordingly, it is intended that where "about" is used with a numerical value, a tolerance of plus or minus 10% is contemplated for that numerical value. The term "substantially", when referring to a number or value, means plus or minus 10% of the value; when referring to a sphere, it means a distorted sphere whose larger diameter is plus or minus 10% of the diameter of the expected sphere.

While the foregoing describes in detail a seamless breakable capsule and method for forming a seamless breakable capsule with reference to specific embodiments thereof, it will be apparent to one skilled in the art that various changes and modifications and equivalents to embodiments and methods as disclosed herein may be employed, which do not materially depart from the spirit and scope of the embodiments disclosed herein.

What is claimed is:

1. A smoking article filter having a flavorant delivery system, the smoking article filter comprising plug wrap surrounding filter material containing the flavorant delivery system, the flavorant delivery system comprising at least one pressure sensitive capsule containing a flavorant, the at least one pressure sensitive capsule configured to release the flavorant by manual rupture of an outer wall of the pressure sensitive capsule, the at least one pressure sensitive capsule embedded in a filter segment including filter tow and the plug wrap surrounding the filter tow, wherein the at least one pressure sensitive capsule comprises an outer shell formed of a cross-linked agar matrix including at least one filler and an inner core which comprises a liquid or gel based composition of the flavorant, wherein the cross-linked agar matrix is reinforced with carboxymethyl cellulose dispersed throughout the agar matrix so as to fill empty spaces in the agar matrix and inhibit the flavorant from passing through the empty spaces, and the at least one filler comprises locust bean gum.

2. The smoking article of claim 1, wherein the at least one filler further comprises konjac, and/or xanthan gum.

3. The smoking article filter of claim 1, wherein the at least one filler further includes pullulan, hydroxypropyl methyl cellulose (HPMC), hydroxypropyl cellulose (HPC), soluble cellulose gum, methyl cellulose, dextrin, maltodextrin, or combinations thereof.

4. The smoking article filter of claim 1, wherein the at least one pressure sensitive capsule is a spherical capsule.

5. The smoking article filter of claim 1, wherein the at least one pressure sensitive capsule is a seamless capsule having a crush strength of about 3 to about 10 Newtons.

6. The smoking article filter of claim 1, wherein the flavorant includes menthol.

7. The smoking article filter of claim 1, wherein the at least one pressure sensitive capsule consists of a single pressure sensitive capsule.

8. The smoking article filter of claim 1, wherein the at least one pressure sensitive capsule comprises at least two pressure sensitive capsules.

9. A smoking article comprising the smoking article filter according to claim 1.

10. The smoking article filter of claim 1, wherein the at least one pressure sensitive capsule comprises more than two pressure sensitive capsules.

11. The smoking article filter of claim 8, wherein the at least two pressure sensitive capsules include menthol as the flavorant.

12. The smoking article of claim 9, wherein the smoking article filter is attached to a tobacco rod of the smoking article.

13. The smoking article of claim 9, wherein the flavorant includes menthol.

14. The smoking article of claim 9, wherein the at least one pressure sensitive capsule comprises at least two pressure sensitive capsules containing menthol as the flavorant.

15. A method of making a smoking article filter comprises wrapping a filter segment in plug wrap, wherein at least one pressure sensitive capsule containing a flavorant is incorporated in the filter segment, the filter segment including the at least one pressure sensitive capsule embedded in filter tow with the plug wrap surrounding the filter tow, wherein the at least one pressure sensitive capsule comprises an outer shell formed of a cross-linked agar matrix including at least one filler and an inner core which comprises a liquid or gel based composition as the flavorant, wherein the cross-linked agar matrix is reinforced with carboxymethyl cellulose dispersed throughout the agar matrix so as to fill empty spaces in the agar matrix and inhibit the flavorant from passing through the empty spaces and the at least one filler comprises locust bean gum.

16. The method of claim 15, wherein the wrapping comprises feeding the plug wrap along a feed path and wrapping the plug wrap around the filter tow traveling along the feed path, wherein the filter segment comprises a section of the filter tow traveling along the feed path.

17. The method of claim 16, wherein at least two of the pressure sensitive capsules are embedded in the section of the filter tow.

18. A method of making a smoking article comprises attaching the smoking article filter according to claim 1 to a tobacco rod.

19. The method of claim 18, wherein the at least one pressure sensitive capsule includes at least two pressure sensitive capsules.

* * * * *